US007944685B2

(12) United States Patent
Nabais Nobre

(10) Patent No.: US 7,944,685 B2
(45) Date of Patent: May 17, 2011

(54) INTERACTIVE DISPLAY CABINET

(75) Inventor: Edmundo Manuel Nabais Nobre, Lisboa (PT)

(73) Assignee: Ydreames Information, S.A., Costa Da Caparica (PT)

( * ) Notice: Subject to any disclaimer, the term of this patent is extended or adjusted under 35 U.S.C. 154(b) by 300 days.

(21) Appl. No.: 12/170,974

(22) Filed: Jul. 10, 2008

(65) Prior Publication Data

US 2009/0015113 A1 Jan. 15, 2009

Related U.S. Application Data

(60) Provisional application No. 60/948,810, filed on Jul. 10, 2007.

(51) Int. Cl.
*G06F 1/16* (2006.01)

(52) U.S. Cl. ..... 361/679.26; 455/575.5; 345/426; 446/478; 348/239

(58) Field of Classification Search ..... 455/575.1, 455/575.5, 556.1; 345/173, 420, 426, 592, 345/419, 581; 62/264; 446/476, 110, 478; 348/207.1, 53, 44, 51, 239; 361/679.01, 679.26, 679.27, 679.03, 679.4
See application file for complete search history.

(56) References Cited

U.S. PATENT DOCUMENTS

| | | | | |
|---|---|---|---|---|
| 5,699,676 | A * | 12/1997 | Trulaske, Sr. | 62/264 |
| 2003/0216157 | A1 * | 11/2003 | Wang et al. | 455/575.1 |
| 2005/0174727 | A1 * | 8/2005 | Thomas et al. | 361/681 |
| 2009/0016003 | A1 * | 1/2009 | Ligtenberg et al. | 361/681 |

FOREIGN PATENT DOCUMENTS

| | | | |
|---|---|---|---|
| FR | 2 680 588 | A1 | 8/1991 |
| JP | 2004-054065 | A | 2/2004 |
| JP | 2005-107546 | A | 4/2005 |
| WO | 93/16625 | A1 | 9/1993 |
| WO | 2005/0833440 | A1 | 9/2005 |

* cited by examiner

*Primary Examiner* — Hung V Duong
(74) *Attorney, Agent, or Firm* — King & Spalding L.L.P.

(57) ABSTRACT

An apparatus including a cabinet which displays content in a screen in response to digital contact with a transparent surface.

11 Claims, 2 Drawing Sheets

INTERACTIVE DISPLAY CABINET

This application claims priority from U.S. Provisional Application No. 60/948,810, filed on Jul. 10, 2007, the disclosure of which is incorporated herein by reference in its entirety.

This invention relates to the concept of display cabinets. It enhances such concept by adding interactivity by associating an exhibition item to content.

BACKGROUND OF THE INVENTION

Traditional cabinets for exhibitions rely on relatively passive elements. A physical object is generally displayed behind a glass panel, which enables the display of the object while giving some level of security. There is at times some dynamic aspects in such exhibitions, e.g., placing an element over a rotating support.

Recently, with the popularization of flat screens, we have images on display, with which a degree of interactivity exists that is generally limited by the exhibited element.

Robust industrial solutions that simultaneously overcome the numerous limitations of the state of the art do not yet exist.

When interactivity occurs in the state of the art, it is limited to a set of responses that, also by architectural constraints, are sometimes purely arbitrary. Frequently, hardware solutions are employed that aim to surpass the volatility associated with software and which typically integrate Flash-memory, of which short supply was traditionally a quantitative restriction to the amount of content that systems would encompass.

In exemplary embodiments of this invention, such constraints are surpassed by the degree of sophistication, which allows for a (programmed) specific reaction instead of a non-specific or even arbitrary reaction, i.e., randomized from a rigid memory pool.

Exemplary embodiments of the present invention can expand the interactivity in cabinet exhibitions. The integration of traditional display elements with extensive databases is present in the state of the art; however, indexing is flawed by problems such as cultural dispersion and jeopardizing object-concept integrity. Exemplary embodiments of the present invention may yield a usability and effectiveness level that is not comprised in the state of the art.

Exemplary embodiments of the present invention aim to replace the traditional catalogue/reference-guide influenced visit, enabling a user-friendly way to provide a virtually unlimited amount of object-contexted information to the user.

Some related art are discussed below.

The patents from GestureTek, and per respective site http://www.gesturetek.com/, associate the triggering of content with positions of the hands—such solution does not rely on contact, as do the several possible exemplary embodiments of this invention. The basic technique is unrelated, and thus, the technical implementation does not overlap, resulting in a dissimilar user experience.

Patents FR2680588, from G.O. Fabric and JP2004054065, from SAEILO JAPAN INC—focus on the barrier between the inside and the outside of stores, aiming to safeguard the interaction equipment; this invention extends the equipment's level of functionality, not dealing with its safeguard.

Patent WO93016625, from Harald Weingärtner—deals with the essential questions surrounding lighting; such is not the scope of this invention, in which the lighting is not arranged to solve a problem, but rather is used in a simple manner to then compose a complex degree of function, but which is not dependent on a particular lighting array.

Patent WO2005083340, from Goran Trifunovic—works in a fundamental different way from this invention, since it reacts to proximity and not to a deliberate input; it moreover includes accessory functions which are not used in this invention. On the other hand, it does not display image or text. Its function is clearly that of an attention grabber, which is not the case of this invention.

Patent JP2005107546 "INTERACTIVE DISPLAY APPARATUS"—refers to an optimization of solutions, that while bearing some resemblance with the present invention, are of a lesser degree of sophistication, resulting in a different functionality.

SUMMARY OF THE INVENTION

A new level of functionality in information access is achieved in the form of display cabinets.

According to an exemplary embodiment of the present invention, a cabinet comprises an element display area and a screen. Sensors in the display area pick up the finger's position against a transparent barrier, such position having been previously calibrated for the elements in exhibition.

A computer has a database of programmed contextual information that it displays through a screen, providing for more direct research on elements of interest in exhibitions.

DETAILED DESCRIPTION OF EXEMPLARY EMBODIMENTS OF THE INVENTION

Figure 1:
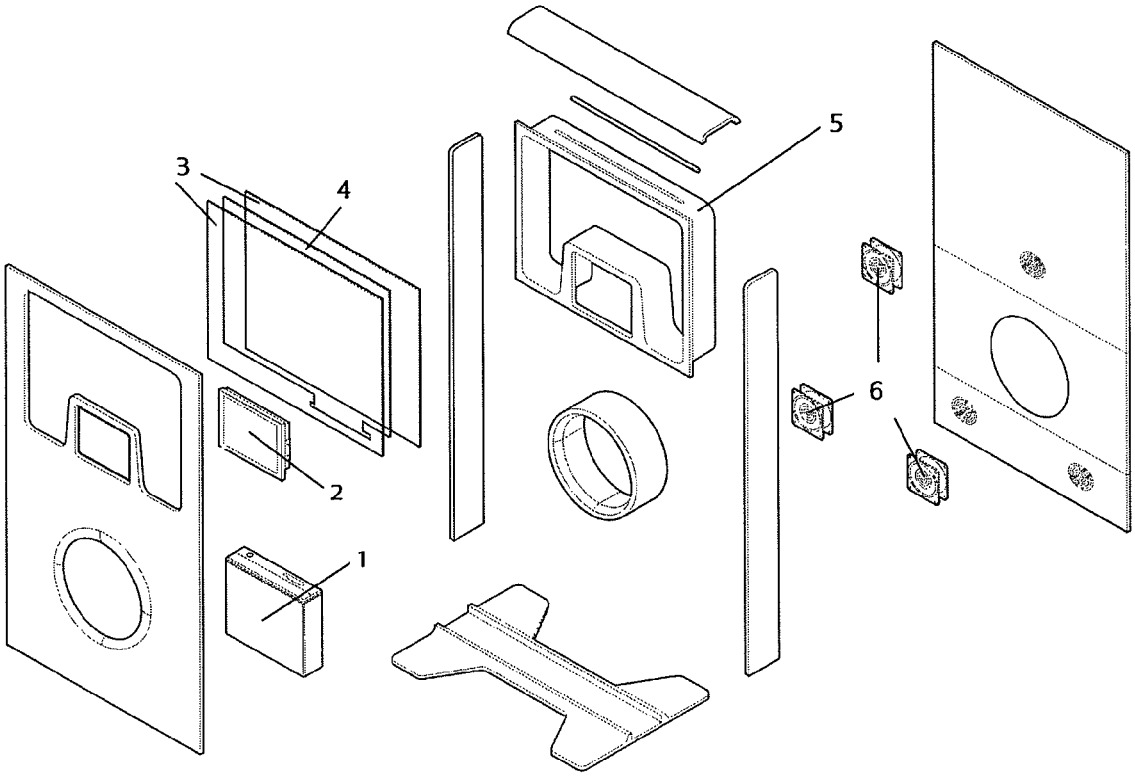
FIG. 1—Exploded view of a cabinet according to an exemplary embodiment.
Figure 2:
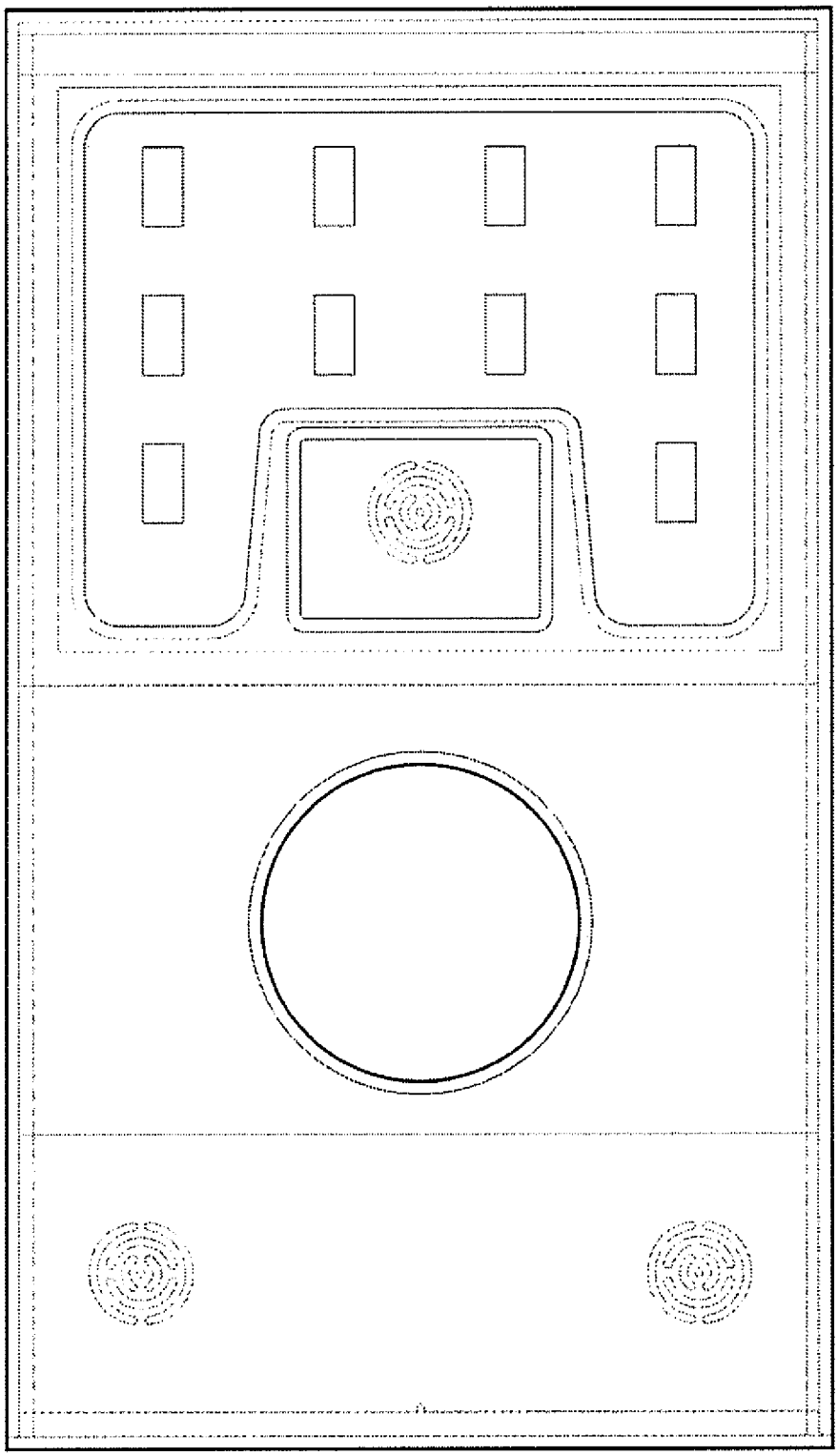
FIG. 2—Frontal view of a cabinet according to an exemplary embodiment.

In an exemplary embodiment of the present invention, there is a cabinet, which displays elements behind a see-through surface (3), and further comprises a screen (2).

When a user points at an element on display in the display space (5) through the see-through surface (3), the capacitative film (4) that is fitted to the see-through surface (3) collects coordinates, which are fed to a computer (1), in which resides an application that triggers a coordinate-specific content that is then displayed on the screen (2).

The materials from which the cabinet can be made are not restricted to a particular material or range of materials as the materials are just used as passive housing for the elements and the system.

The see-through surface (3) may be in a variety of transparent materials, such as but not limited to acrylic, Plexiglas or glass.

The screen (2) may be a simple LCD, or a touch-screen for bi-directional functionality, that is—not only pressing the capacitative film (4) will cause content to be displayed in the screen (2), but also pressing the screen in the case that it is a touch-screen may initiate an effect in the display space (5), e.g., the object selected on the screen (2) object being highlighted in the display space (5) by means of a lighting system built into the display space (5).

In another exemplary embodiment, the capacitative film (4) can be substituted by sonic sensors, for instance using ultra-sound spectography. The method of detection is not rigid, as any sensor that can pinpoint digital contact on the see-through surface (3) can be allowed.

In yet another exemplary embodiment, the invention further comprises lights interior to the cabinet for highlighting exhibit elements in the display space (5). LEDs can be used, if the temperature inside the cabinet is a concern.

The light can light up after at least 2 events:

when the element they light is selected by digital contact to the see-through surface (3);

conversely, when the database is navigated in a traditional manner through a touch screen (2), and an element is selected. This configures bi-directional focus of the light component.

Additional aspects of the invention will become apparent to those skilled in the art upon examination of the description, or may be learned by practice of the invention. The examples and drawings herein are provided by way of illustration, and are not intended to be limiting of the scope of the present invention.

What is claimed is:

1. An interactive display cabinet comprising:

a cabinet comprising a see-through surface;

a touchscreen embedded and/or attached to the cabinet, the touchscreen configured to display content allowing a user to navigate and select from a plurality of objects;

a computer processing unit that runs an application, wherein a display of the touchscreen is determined by digital contact with the see-through surface; and at least one light interior to the cabinet for highlighting an object to be displayed, wherein the light is activated in response to each of the following events:

selection of the object by contact with the see-through surface, and selection of the object by navigation via the touchscreen.

2. The interactive display cabinet according to claim 1, wherein the see-through surface is fitted with an electrocapacitative film.

3. The interactive display cabinet according to claim 1, wherein the sec-through surface is fitted with sonic sensors.

4. The interactive display cabinet according to claim 1, wherein the computer processing unit is an industrial computer.

5. The interactive display cabinet according to claim 1, wherein a light visible through the see-through surface is activated by a user selection on the flat screen.

6. An interactive display cabinet comprising:

a cabinet comprising a surface;

a touchscreen associated with the cabinet, the touchscreen configured to display content allowing a user to navigate and select from a plurality of objects;

wherein a display of the touchscreen is determined by contact with the surface; and at least one light interior to the cabinet for highlighting an object to be displayed, wherein the light is activated in response to each of the following events:

selection of the object by contact with the see-through surface, and selection of the object by navigation via the touchscreen.

7. The interactive display cabinet according to claim 6, wherein said surface is a see-through surface.

8. The interactive display cabinet according to claim 6, wherein said contact includes digital contact.

9. The interactive display cabinet according to claim 6, wherein a capacitative film is fitted to the surface.

10. The interactive display cabinet according to claim 9, further comprising a computer processing unit, wherein at least one coordinate is collected via said capacitative film and transmitted to said computer processing unit.

11. The interactive display cabinet according to claim 6, wherein an object is displayed via said touchscreen based on the contact with the surface.

* * * * *